United States Patent [19]

Benson et al.

[11] Patent Number: 4,638,665

[45] Date of Patent: Jan. 27, 1987

[54] TUBE BENDER

[75] Inventors: David A. Benson, Hutchinson; Ray A. Dilts, Sedgwick, both of Kans.

[73] Assignee: Full Vision, Inc., Newton, Kans.

[21] Appl. No.: 783,734

[22] Filed: Oct. 3, 1985

[51] Int. Cl.[4] ..... B21D 9/05

[52] U.S. Cl. ..... 72/389; 72/383; 72/460

[58] Field of Search ..... 72/383, 386, 389, 460

[56] References Cited

U.S. PATENT DOCUMENTS

| | | | |
|---|---|---|---|
| 2,100,961 | 11/1937 | Jones et al. | 72/389 |
| 3,918,286 | 11/1975 | Whitehead | 72/389 |
| 4,004,445 | 1/1977 | Larson | 72/389 |
| 4,005,593 | 2/1977 | Goldberg | 72/389 |
| 4,485,664 | 12/1984 | Richards | 72/389 |

*Primary Examiner*—W. D. Bray

*Attorney, Agent, or Firm*—Schmidt, Johnson, Hovey & Williams

[57] ABSTRACT

A bending machine is provided to form a multiplicity of predetermined types of bends within several planes in elongated, heavy gauge workpieces of various sizes and shapes by pressure between a stack of dies and a pair of swingable anvil plates carried by elongated wings each of which is, in turn, swingable to adjust the distance between the anvils. Slide rails for the workpiece are readily accessible for loading and unloading. The die stack includes releasable vise-like clamps which grip the workpiece to preclude distortion during bending, and the stack can be raised or lowered to provide proper alignment of preselected die units of the stack.

18 Claims, 10 Drawing Figures

TUBE BENDER

BACKGROUND OF THE INVENTION

1. Field of the Invention

This invention relates to the bending of elongated workpieces, usually of a metallic, tubular nature and normally having a polygonal cross-sectional configuration, typically square or rectangular, by the action of forces applied thereto between a die and a pair of spaced anvils.

We are familiar with apparatus for curving or bending rods, pipe, tubing, straps or wire using a rigidly-supported cylinder whose piston rod has a pair of spaced rollers for imparting a thrust against a rigidly-supported rod to be bent. A third, rigidly-supported roller engages the rod at the concave surface of the bend in the rod. Oftentimes the rollers are called primary and secondary "dies" and in some instances the two secondary dies are adjustable toward and away from each other for the purpose of predetermining the desired bend configuration. It has also been suggested that the third or primary die be in the nature of a hemicylindrical member rather than a roller, as such, with all three dies power actuated during the bending operation as the primary die is shifted relative to the secondary dies.

In other instances the secondary dies are referred to as rotatable "posts" and the primary die is an adjustable "mandrel" actuated by the piston rod of a swingable cylinder with the tube bending around the mandrel. It has also been suggested that there be provided a "kinker" or crimper on the mandrel for purposely distorting the walls of square or rectangular tubing along the zone of bending, the theory being uniform distribution of excess material and preventing wall distortions. In such instances, opposed walls of the tubing bend inwardly toward each other at the bend. It is also not uncommon to use conical or cylindrical, detachable or replaceable rollers, with the distances therebetween being adjustable.

2. Summary of the Invention

In accordance with the concepts of our present invention, a pair of anvil plates are swingably mounted on a pair of long, stout wings each of which is, in turn, independently swingable and held in preselected positions in accordance with the needs of the operator or our tube bender.

The bender is also especially characterized by a die assembly of high utility in that a stack of die units is employed such that a multiplicity of differing, multiplane bends can be made quickly and easily in a single workpiece without need for die changes or a number of separate benders. We contemplate also an open, unobstructed construction which permits top loading and unloading of the workpiece devoid of the need to "thread" the tube longitudinally thereof into and out of position between the dies and the anvils.

Another important feature of the instant tube bender relates to the way the stack of dies can be raised and lowered such as to properly align the selected die unit with the anvils and bring the same into proper relationship to a pair of tube-supporting rails.

Moreover, we provide for mechanism which releasably clamps all of the plates of the die assembly together, certain of such plates also gripping, in a vise-like manner, the tube itself to avoid improper distortion of the tube material while bending takes place.

IN THE DRAWINGS

Figure 3:
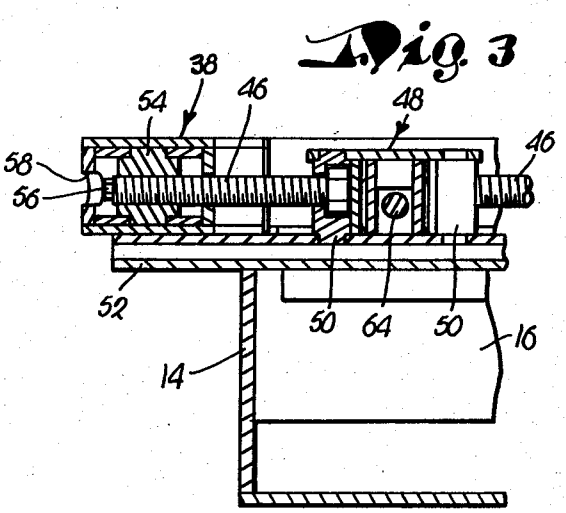
Figure 1:
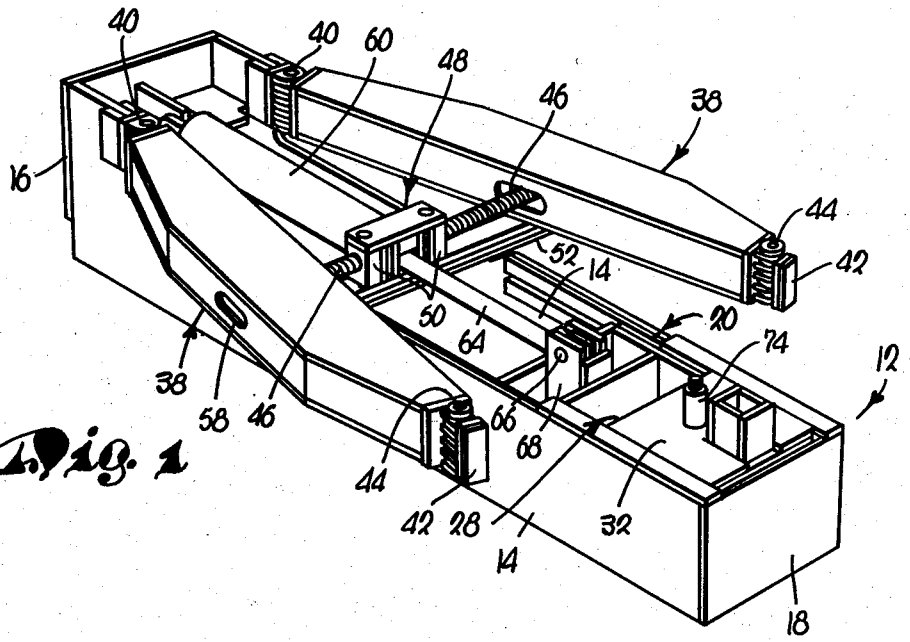
FIG. 1 is a perspective view of a tube bender made pursuant to our present invention.
Figure 2:
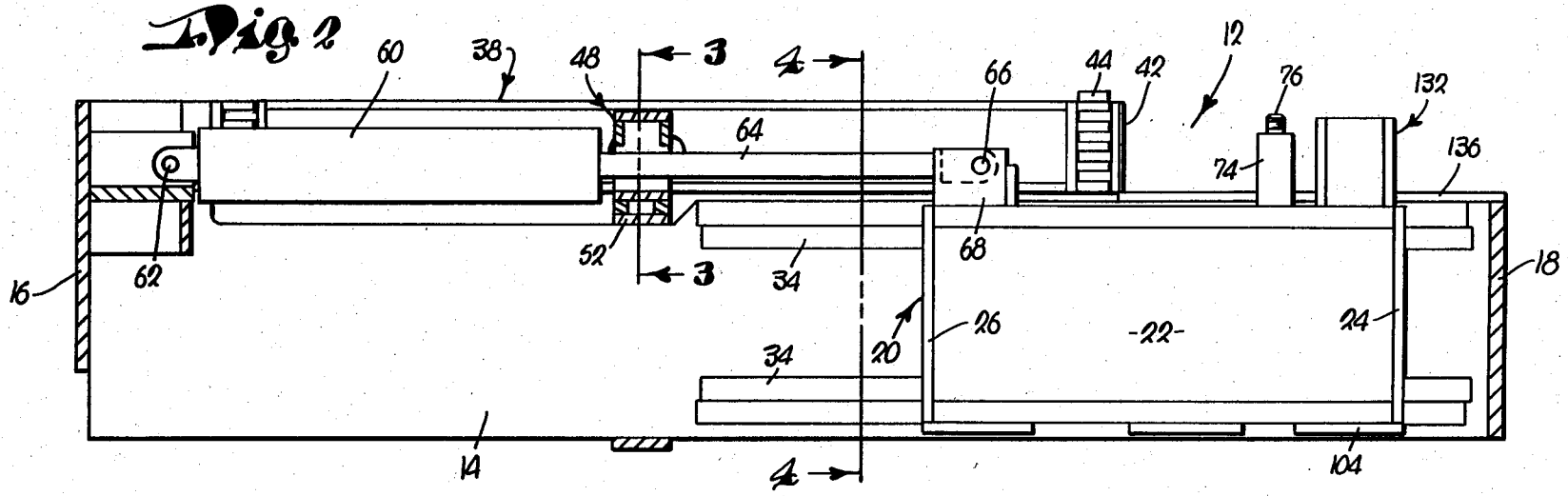
FIG. 2 is a longitudinal cross-sectional view thereof.
Figure 8:
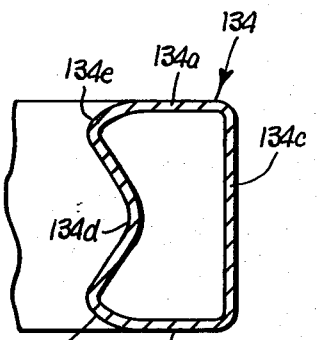
Figure 5:
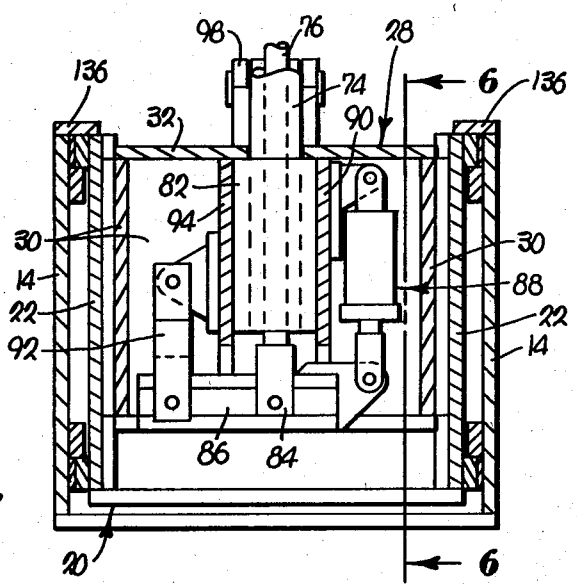
Figure 7:
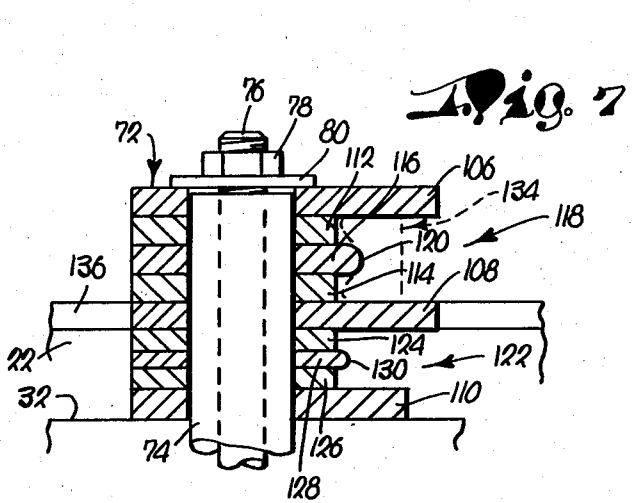
Figure 4:
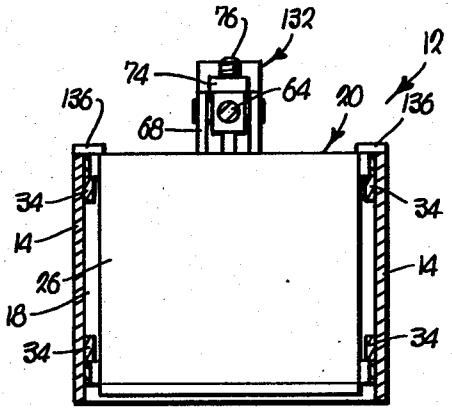
Figure 6:
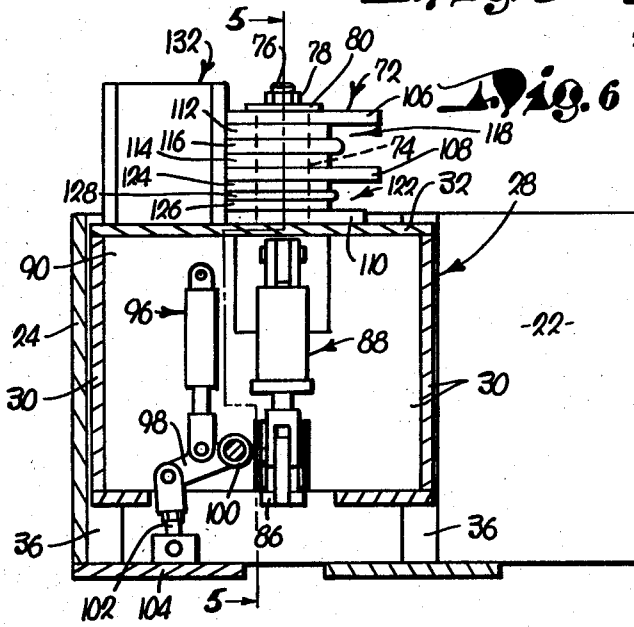
Figure 10:
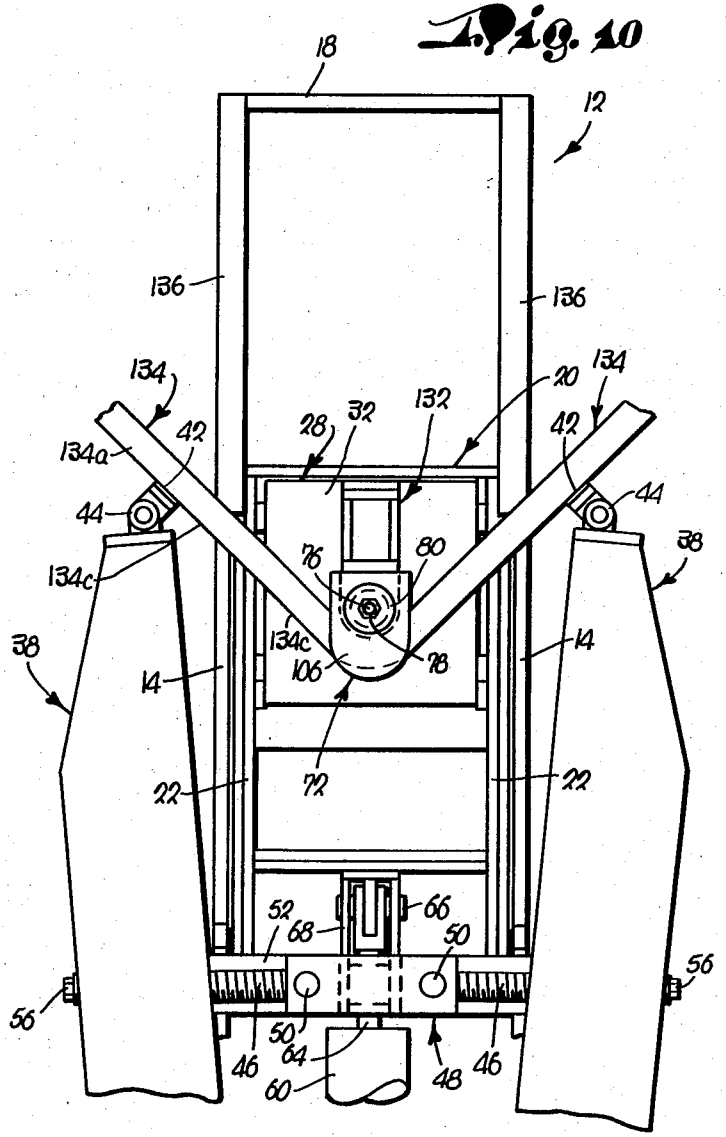
Figure 9:
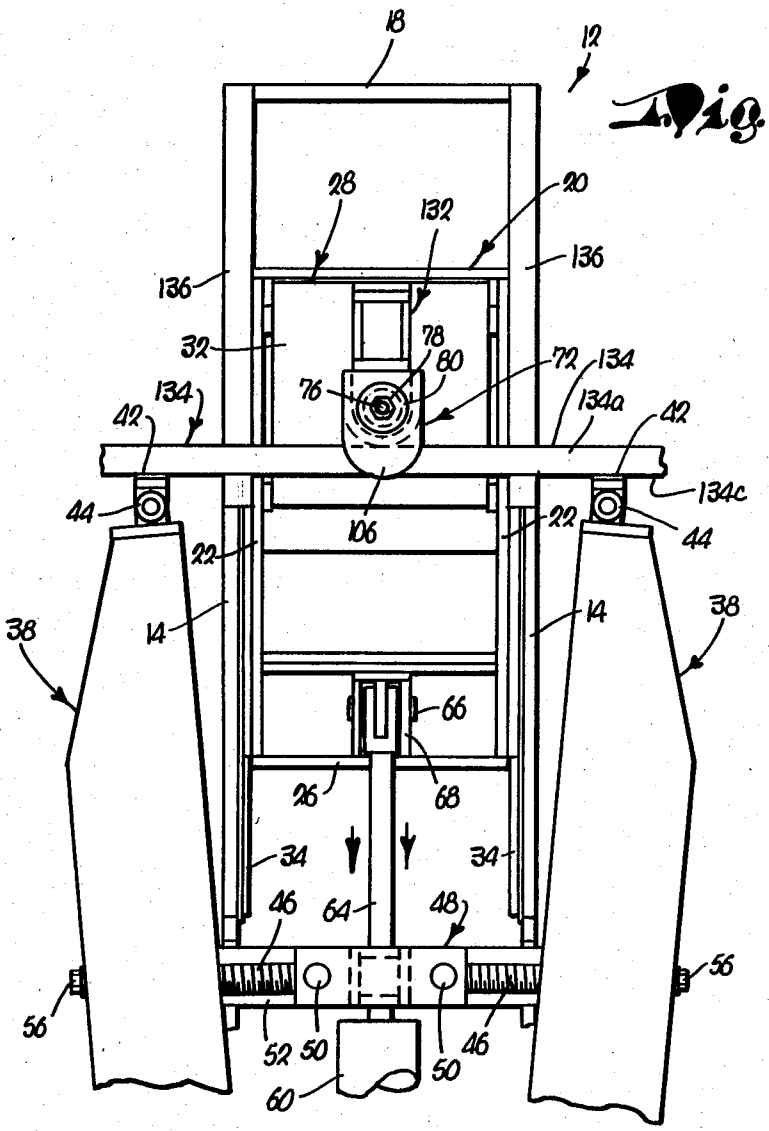

FIGS. 3 and 4 are fragmentary, cross-sectional views taken on lines 3—3 and 4—4 respectively of FIG. 2;

FIG. 5 is a cross-sectional view taken on lines 5—5 of FIG. 6 with the die assembly removed;

FIG. 6 is a cross-sectional view taken on lines 6—6 of FIG. 5;

FIG. 7 is an enlarged, cross-sectional view through the die assembly;

FIG. 8 is a cross-sectional view of the bent tube at the center of the bend;

FIG. 9 is a fragmentary top view of the bender showing the die against the tube and the tube against the anvils; and FIG. 10 is a view similar to FIG. 9 showing the tube bent.

DESCRIPTION OF THE PREFERRED EMBODIMENT

An elongated, primary support 12 in the nature of an open top, hollow housing has a pair of spaced, parallel side walls 14 and a pair of spaced, parallel end walls 16 and 18. An elongated, secondary support 20, also in the nature of an open top, hollow housing within the support 12 between the walls 14, is horizontally reciprocable longitudinally of the support 12 toward and away from the walls 16 and 18. The support 20 is also provided with a pair of spaced, parallel side walls 22 and a pair of spaced, parallel end walls 24 and 26. An essentially cubical, hollow, tertiary support 28 within the support 20 between the walls 22 adjacent the wall 24 is vertically reciprocable with respect to the support 20. The support 28 has four upstanding walls 30 and a top wall 32. Horizontal guides 34 slidably receive the support 20 and vertical guides 36 slidably receive the support 28.

The walls 14 support a pair of elongated, hollow beams or wings 38 adjacent the wall 16 for swinging movement about vertical axes 40 at the rear ends of the beams 38. The forward ends of the beams 38 have anvil plates 42 thereon swingable about vertical axes 44. A screw 46 traverses each beam 38 intermediate the ends of the latter for swinging the beams 38 toward and away from each other. A central fixture 48 between the beams 38 has a pair of spaced retainers 50 rotatably receiving the heads of the screws 46. the retainers 50 are attached to a crosshead 52, secured to the walls 14 and slidably supporting the beams 38. Each beam 38 has a nut 54 fixed therewithin and threaded on its screw 46. Wrench-engaging flats 56 on the screws 46 are accessible through outer slots 58 in the beams 38.

The support 20 is reciprocated within the support 12 by a hydraulic cylinder 60 having a pivotal connection 62 with the walls 14, 14, 16 and provided with a piston rod 64 passing freely through the fixture 48 between the retainers 50. The outer forward end of the rod 64 has a pivotal connection 66 with a number of upstanding plates 68 secured rigidly in an upright container 70 firmly mounted in the support 20 and on the wall 26. The line of pull (or force) of the rod 64 is on the center line of a die stack or assembly 72.

The wall 32 supports the die assembly 72 by means of a pipe 74 (rigid to the wall 32) surrounding a threaded bolt 76 having a nut 78 above a washer 80. The bolt 76, passing slidably through a block 82 rigid to the wall 32, has a pivotal connection with a bar 86 within the support 28, and a hydraulic piston and cylinder unit 88 pivotally interconnects a partition 90 and the bar 86. Diametrically opposite the unit 88 a link 92 pivotally interconnects a second partition 94 and the bar 86 (FIG. 5). The partitions 90 and 94 span the distance between a pair of the walls 30 front to back of the support 28 and rigidly confine the block 82.

Forwardly of the unit 88, the partitions 90, 94 pivotally support a pair of hydraulic piston and cylinder units 96 (one only having shown in FIG. 6), pivotally coupled with a crank 98 radiating from a sleeve 100 rotatably carried by the partitions 90, 94 therebetween. A link 102 pivotally connects the crank 98 with bottom 104 of the support 20.

The assembly 72, as best seen in FIG. 7 (see also FIGS. 6, 9 and 10) comprises a series of flat, superimposed plates, all having straight, vertically aligned, rear edges and all having convex leading edges although the shape of the front edges is of no consequence in a top retainer plate 106, an intermediate retainer plate 108 and a lower retainer plate 110. A pair of spaced die plates 112 and 114 between the plates 106 and 108 and a median plate die 116 between the plates 112 and 114 comprise a first upper die unit 118, the plate 116 extending forwardly beyond the plates 112 and 114, presenting a nose 120.

A second, lower die unit 122 includes the plates 108 and 110, die plates 124 and 126 (comparable to the plates 112, 114) and a median die plate 128 (comparable to the plate 116) having a nose 130 protruding beyond the plates 124, 126.

To be noted is that all the retainer plates 106, 108 and 110 extend forwardly beyond the leading edges of the die plates 112, 114, 120, 124, 126 and 128. All nine plates of the assembly 72 are initially loosely rotatable on the pipe 74, resting on the support 28 with the plate 110 engaging the wall 32. However, when the assembly 72 is pulled toward the fixture 48 by retraction of the rod 64, the plates are all held against rotation by a back-up pusher 132 on the wall 32 flatly engaging the rear edges of the plates.

The workpiece or tube 134 to be bent is illustrated in FIG. 9, and during movement thereof it slides along a pair of spaced rails 136 extending along the support 12 at the upper edges of the walls 14—14.

OPERATION

By way of example only, the transversely rectangular tube is approximately 3" wide and about 2" deep or high (from the rails 136 to the top of the tube 134, viewing FIG. 9). Hence, the initial distance between the plates 106 and 108 is at least 3" to permit easy insertion of the tube 134 therebetween as seen in FIG. 9. At this juncture the wall 32 is held just high enough by the units 96 to cause the tube 134 to rest on the rails 136, as seen in FIG. 7.

Thereupon, before the rod 64 is actuated, the unit 88 is actuated to pull the bolt 76 downwardly until all the plates of the assembly 72 are tightly clamped between the washer 80 and the wall 32. However, no tight clamping of any such plates is necessary except for plates 106 and 108 tightly gripping the upper face **134*a* and the lower face 134*b* of the tube 134**.

Then, as the rod 64 is retracted, the plates 112, 114 and 116 push the tube 134 toward the anvils 42 until the latter are engaged by leading face **134*c* of the tube 134. Note in FIG. 10 that the anvils 42 have rotated on their axes 44 to present a pair of right angle stretches in the tube 134 extending oppositely from the zone of bend and, as seen in FIG. 8, because of the clamping action aforedescribed, the walls of the tube 134 (defining faces 134*a* and 134*b*) remain normal to the wall defined by the face 134*c*. This highly important feature results notwithstanding the indentation 134*d* formed in the trailing face of the tube 134 at the zone of the bend by the nose 120**.

Accordingly, the metallic material from which the tube 134 is made readily stretches to form arcuate corners **134*e* without spreading of the top and bottom walls of the tube 134 away from each other, restrained by the plates 106 and 108. By the same token, excess tube material is uniformly distributed by the formation of the indentation 134*d* toward the leading face 134*c* of the tube 134. Note in FIG. 8 that there are no distortions such as wrinkles, creases, ridges, furrows or other deformations in the tube 134** anywhere within the zone of bend.

After retraction of the bent tube 134 away from the anvils 42, the grip thereon is released by operation of the unit 88 such that the tube 134 can be easily and readily slipped out from between the plates 106 and 108. Placement of the tube 134 onto the rails 136 and removal therefrom are without interference by any structure between the anvils 42 and the assembly 72.

Before removal however, additional bends may be formed in either or both of the two stretches of the bent tube 134. In such instances, either the face **134*c* or the opposite face of the tube 134 may be pressed against the anvils 42, depending on the desired configuration of the finished tube 134**.

On the other hand, if the top and/or the bottom of the tube 134 are to be bent by moving face **134*a* and/or face 134*b* against the anvils 42, the unit 122 is employed. For such purposes, the distance between the plates 108 and 110 is less than the distance between plates 106 and 108 as seen in FIG. 7. And, in these operations, the plates 108 and 110 serve as clamping members, the same as above described with respect to the bend illustrated in FIG.8**.

However, here we have as the initial step, actuation of the units 96 to raise the wall 32, and, therefore, the assembly 72 in order to bring the plate 110 as high as the rails 136 so that when the workpiece is laid on the rails 136 it can be easily and quickly shifted into place between the plates 108, 110 against the nose 130. The design of the beams or wings 38 permits closer bending in such two plane bends than has been possible in tube benders heretofore suggested.

It can now be readily understood that the adjustable distance between the anvils 42 depends on the nature of the bend to be formed. Moreover, the die units 118 and 122 are readily replaceable with any number of standby units having die plates of differing characteristics. The curvatures of the leading edges of the die plates 112, 114, 120, 124, 126 and 130 need not be semicircular. Also, the thicknesses of the plates of the assembly 72 may vary, and the overall widths thereof across their trailing edges or through the axis of the bolt 76 may be preselected. Additionally, very little change in the bender is required to permit the pipe 74 and the bolt 76 to accomodate a higher stack of die units. And, to be sure, the depth of the indentation **134*d* may well vary in accordance with the nature of the workpiece to be bent and the kind of bend to be formed. Finally, it is not necessary in all uses that the distances of the anvils 42** from the longitudinal centerline of the support 12 be identical.

The bender above described leads itself well to a central programmable controller including control of the clamping and unclamping mechanism and control of the bending operation by sensing the degree of bend rather than the length of stroke of cylinder 60 for shifting the heavy gauge tube. As many as ten hot or cold bends on any single tube 134 can thus be automatically controlled. The instant invention also lends itself to the provision of encoders mounted on the axles or pivot pins 44 of the anvils 42 and capable of "reading" the zero before each bend is commenced and operating to discontinue the bending at any predetermined angle.

We also deem it highly important that the die assembly 72 has no top connection to the rod 64, avoiding interference with placement of the tube 134 on and removal from the rails 136.

We claim:

1. A tube bender comprising:

an enlongated, primary support;

a secondary support carried by the primary support for reciprocation longitudinally of the primary support;

power means interconnecting the supports for reciprocating the secondary support;

a die assembly carried by the secondary support for reciprocation therewith, said assembly including:

a pair of members disposed to receive a bendable tube therebetween, a die between the members, presenting a core around which the tube is bent, and releasable means for clamping the members against the tube; and a pair of spaced anvils carried by the primary support within the path of travel of the tube against which the latter is pressed into shape.

2. The invention of claim 1; and a pair of elongated beams mounted at one end thereof on the primary support for swinging movement toward and away from each other, said anvils being on the opposite ends of the beams, said beams having means for swinging the same.

3. The invention of claim 2; and means securing the anvils to the beams for swinging movement about axes parallel to the axes of swinging movement of the beams.

4. The invention of claim 2, said means for swinging the beams being a take-up unit coupling each beam respectively with the primary support intermediate the ends of the beams.

5. The invention of claim 2, said power means being a fluid pressure piston and cylinder assembly between the beams for pulling the die assembly toward the anvils, including a cylinder pivotally connected to the primary support and a piston rod pivotally connected to the secondary support.

6. The invention of claim 5, said rod intersecting said means for swinging the beams.

7. A tube bender comprising:

an elongated, primary support;

a secondary support carried by the primary support for reciprocation longitudinally of the primary support;

power means interconnecting the supports for reciprocating the secondary support;

a die assembly carried by the secondary support for reciprocation therewith, said assembly including a die around which the tube is bent;

a pair of spaced anvils carried by the primary support within the path of travel of the tube against which the latter is pressed into shape;

a pair of elongated beams mounted at one end thereof on the primary support for swinging movement toward and away from each other, said anvils being on the opposite ends of the beams;

means securing the anvils to the beams for swinging movement about axes parallel to the axes of swinging movement of the beams;

there being means for swinging the said beams, said beam-swinging means being a take-up unit coupling each beam respectively with the primary support intermediate the ends of the beams.

8. The invention of claim 7, said power means being a fluid pressure piston and cylinder assembly between the beams for pulling the die assembly toward the anvils, including a cylinder pivotally connected to the primary support and a piston rod pivotally connected to the secondary support.

9. The invention of claim 8, said rod intersecting said means for swinging the beams.

10. A tube bender comprising:

normally stationary anvil means;

a reciprocable assembly having means for clamping a bendable tube thereto and provided with a die;

primary power means for shifting said assembly to bend the tube between the die and the anvil means; and secondary power means coupled with the clamping means for releasing the tube after it has been bent.

11. The invention of claim 10, said die having means for folding the tube material inwardly into the tube during bending.

12. The invention of claim 10, said assembly being provided with an underlying support; and means for withdrawing said support after the tube is bent.

13. The invention of claim 10, said clamping means including a vise having a pair of tube-engaging jaws adapted to be opened and closed by said secondary power means.

14. The invention of claim 13, said die being disposed between the jaws and held thereby when the tube is clamped therebetween.

15. The invention of claim 14, wherein said assembly is provided with a number of dies for accommodating tubes of varous cross-sectional sizes, there being a vise for each die respectively.

16. The invention of claim 15; and means for aligning preselected dies with said anvil means.

17. The invention of claim 16, said assembly being reciprocable horizontally and said dies being movable vertically; and means for raising and lowering the dies to align preselected dies with the anvil means.

18. A tube bender comprising:

an elongated, primary support;

a secondary support carried by the primary support for reciprocation longitudinally of the primary support;

power means interconnecting the supports for reciprocating the secondary support;

a die assembly carried by the secondary support for reciprocation therewith, said assembly including a die around which the tube is bent;

a pair of elongated beams mounted at one end thereof on the primary support, there being means for swinging movement of the beams toward and away from each other during adjustment of the tube bender and prior to tube bending operations, and for maintaining the beams in a stationary position during tube bending operations;

a pair of tube-engaging anvils; and means mounting one of said anvils adjacent the opposite end of each beam for pivotal movement of each of the anvils about a respective axis transverse to the axis of reciprocation of said secondary support.

* * * * *